US007311578B2

(12) United States Patent
Stanley et al.

(10) Patent No.: US 7,311,578 B2
(45) Date of Patent: Dec. 25, 2007

(54) RIDING TOY

(76) Inventors: Stephen C. Stanley, 632 Barrocliff, Clemmons, NC (US) 27012; David K. Stanley, 800 Montrose Dr., Greensboro, NC (US) 27410

( * ) Notice: Subject to any disclaimer, the term of this patent is extended or adjusted under 35 U.S.C. 154(b) by 27 days.

(21) Appl. No.: 11/013,616

(22) Filed: Dec. 16, 2004

(65) Prior Publication Data

US 2006/0135031 A1 Jun. 22, 2006

(51) Int. Cl.
*A63H 33/00* (2006.01)

(52) U.S. Cl. ..... 446/26; 446/28; 446/230

(58) Field of Classification Search ..... 472/26, 472/28, 7, 230, 491; 446/26, 28, 7, 230, 446/491

See application file for complete search history.

(56) References Cited

U.S. PATENT DOCUMENTS 2,738,974 A * 3/1956 Vincent ..... 446/28
2,864,613 A * 12/1958 Porter ..... 446/28
2,888,263 A * 5/1959 Ruhmann et al. ..... 446/26
3,120,716 A * 2/1964 Orenstein ..... 446/7
3,608,234 A * 9/1971 Davidson ..... 446/28
3,715,832 A * 2/1973 Torres ..... 446/7
4,281,472 A * 8/1981 Hill ..... 446/26
4,848,067 A * 7/1989 Martinsen ..... 54/44.2
5,000,712 A * 3/1991 Curry, Sr. ..... 446/26
5,316,515 A * 5/1994 Hyman et al. ..... 446/28
6,173,450 B1 * 1/2001 Hari ..... 2/69

* cited by examiner

*Primary Examiner*—Kien Nguyen
(74) *Attorney, Agent, or Firm*—Adams Evans P.A.

(57) ABSTRACT

A riding toy includes a body simulating a physical object and having a recessed area adapted to receive a human rider's torso. A harness is adapted to be worn by a human carrier, such that the rider is supported in front of the carrier and the body is supported in front of the rider. The body may take on various forms including vehicles and animals, and may include one or more interactive features. The body may also be worn directly by the rider, or may be mounted on a rolling chassis.

14 Claims, 12 Drawing Sheets

Fig. 3
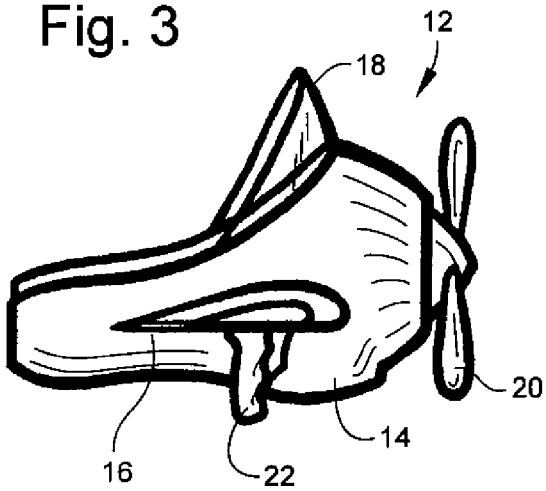
Fig. 4
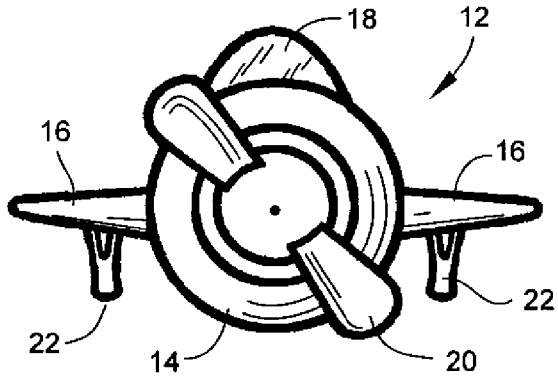
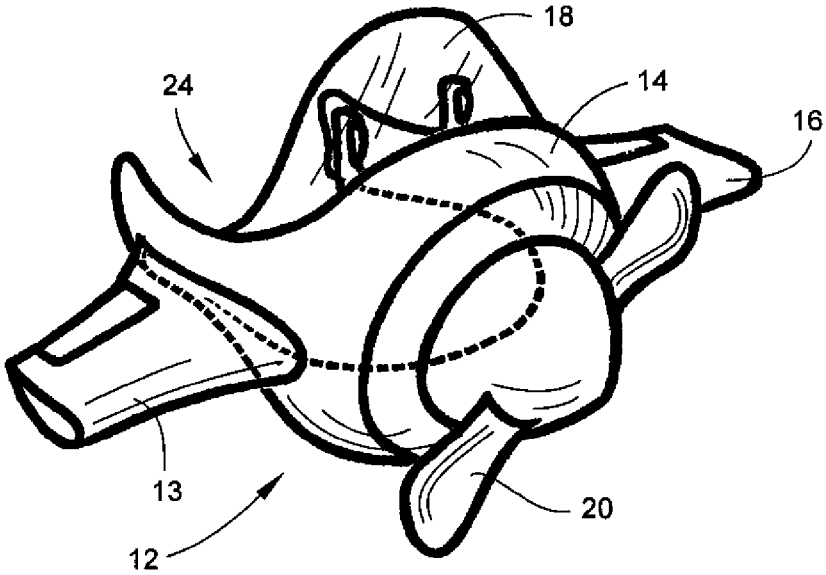
Fig. 2

RIDING TOY

BACKGROUND OF THE INVENTION

This invention relates generally to toys or amusement devices and more particularly to a toy having a body representative of a physical object.

Many toys exist which simulate vehicles, animals, or the like. These prior art toys may be small enough that a child can manipulate them by hand, or they may be of a larger size and mounted on a chassis or frame so that they can be ridden by a child. Unfortunately, these types of toys have not heretofore allowed a parent to interact with a child while the toy is in use. It is also known to provide a harness so that a parent may carry a child suspended from his or her shoulders while maintaining his or her hands free to tend to the child or perform other tasks. However, these harnesses are merely utilitarian and do not provide an entertaining experience for the child.

Accordingly, there is a need for a toy which allows a parent to carry a child as well as interact with the child to create a play experience.

BRIEF SUMMARY OF THE INVENTION

Therefore, it is an object of the invention to provide a riding toy which can be carried by a parent.

It is another object of the invention to provide a riding toy which leaves the parent's hands free to manipulate the toy or to attend to the child.

It is another object of the invention to provide a riding toy which can be easily attached and detached from a support harness.

It is another object of the invention to provide a riding toy which may be worn by a child.

These and other objects are met by the present invention, which according to one aspect provides a riding toy, including a body simulating a physical object and having a recessed area adapted to receive a human rider's torso; and a harness for being worn by a human carrier. The harness includes structure for supporting the rider in front of the carrier; and structure for supporting the body in front of the rider.

According to another aspect of the invention, the body simulates a vehicle.

According to another aspect of the invention, the body includes a simulated control panel.

According to another aspect of the invention, the control panel includes at least one simulated instrument.

According to another aspect of the invention, the control panel includes at least one switch.

According to another aspect of the invention, the switch is operatively connected to the simulated instrument so as to cause a change in the indication of the simulated instrument in response to movement of the switch.

According to another aspect of the invention, the body includes a simulated primary control.

According to another aspect of the invention, the primary control is operatively connected to at least one moveable part of the body so as to cause movement of the moveable part in response to movement of the primary control.

According to another aspect of the invention, the body is representative of an aircraft having a fuselage and a pair of laterally-extending wings.

According to another aspect of the invention, the body is representative of an animal.

According to another aspect of the invention, the harness includes: a carrier portion for being strapped around the carrier; a rider portion attached to the carrier portion and adapted to support a rider in front of the carrier; and structure for mounting the body to the harness in front of the carrier.

According to another aspect of the invention, the means for supporting the body comprise at least one elongated support strap connected to the body and to the carrier portion of the harness.

According to another aspect of the invention, the harness includes at least one harness mount, and an upper end of the support strap is connected to the harness mount.

According to another aspect of the invention, the support strap includes a protruding stud disposed at the upper end thereof, and the harness mount is adapted to selectively engage or release the stud.

According to another aspect of the invention, the body includes at least one handle disposed thereon positioned so as to permit the carrier to manipulate the attitude of the body by movement of the handle.

According to another aspect of the invention a riding toy includes a body simulating a physical object and having a recessed area adapted to receive a human rider's torso; and a wheeled chassis including a seat for the rider. The chassis is adapted to support the body in operative relationship to the rider in the seat. Structure is provided for selectively attaching the body to the support chassis.

According to another aspect of the invention, the structure for attaching the body includes: a downward-protruding bracket attached to the body; and a pair of rails attached to the chassis. The rails are moveable between an open position and a closed position in which they securely engage the bracket so as to retain the body to the chassis.

According to another aspect of the invention, the chassis includes a handlebar attached thereto and positioned to as to allow the chassis to be pushed by a user.

According to another aspect of the invention, the riding toy further includes a brake for selectively slowing the chassis.

According to another aspect of the invention, the chassis includes: a lower portion which carries a plurality of wheels rotatably mounted thereto; and an upper portion which carries the body and the seat, the upper portion being pivotally mounted to the lower portion.

According to another aspect of the invention, a riding toy includes: a body simulating a physical object and having a recessed area adapted to receive a human user's torso; and a harness attached to the body and adapted to be worn by a user so as to support the body in the front of the user.

BRIEF DESCRIPTION OF THE DRAWINGS

The invention may be best understood by reference to the following description taken in conjunction with the accompanying drawing figures in which:

FIG. 2 is a schematic perspective view of a body of the toy of FIG. 1;

FIG. 3 is a side view of the body of FIG. 2;

FIG. 4 is a front view of the body of FIG. 2;

DETAILED DESCRIPTION OF THE INVENTION

Figure 1:
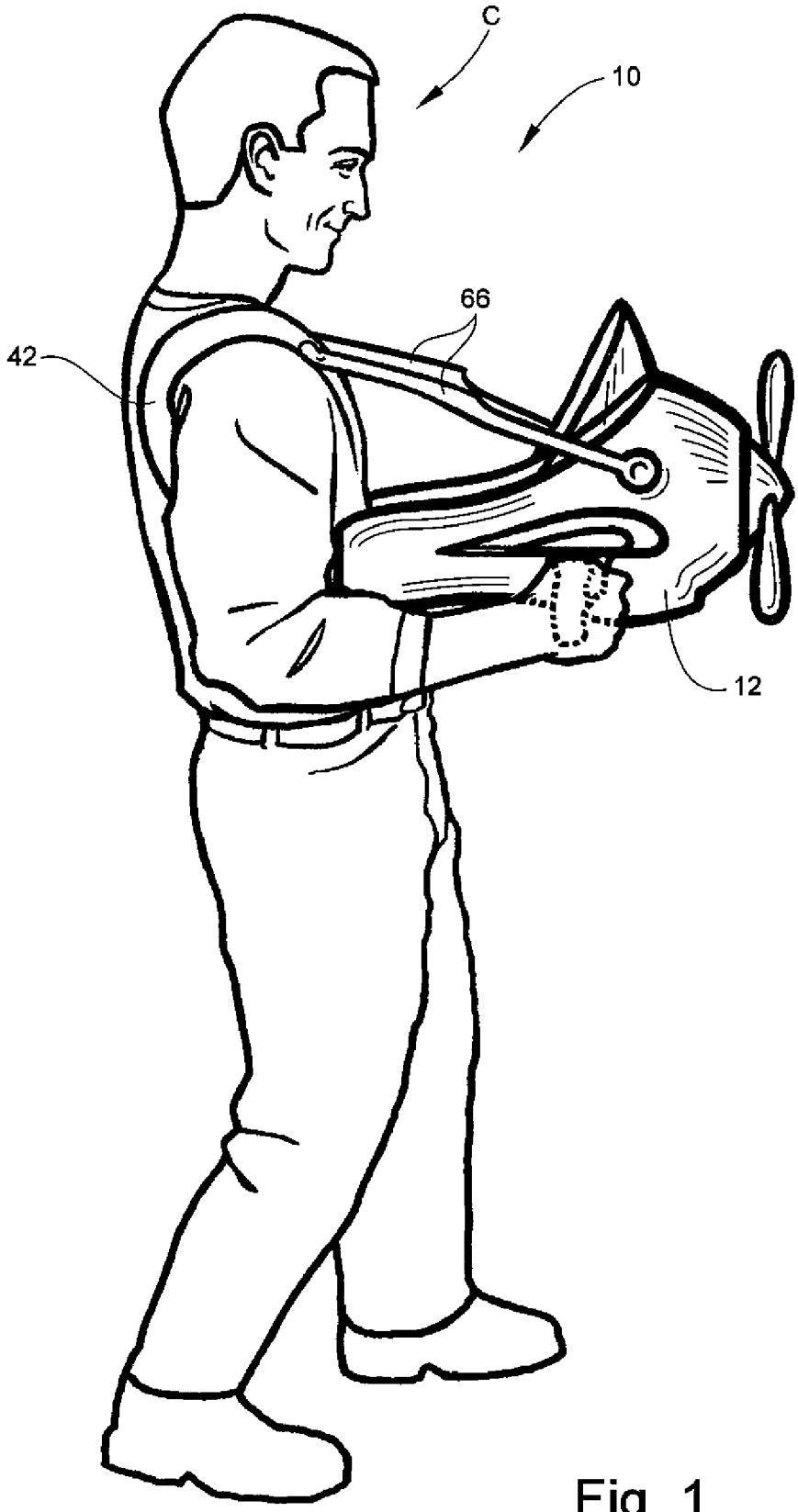
FIG. 1 is a side view of a person holding a toy constructed in accordance with the present invention.
Figure 5:
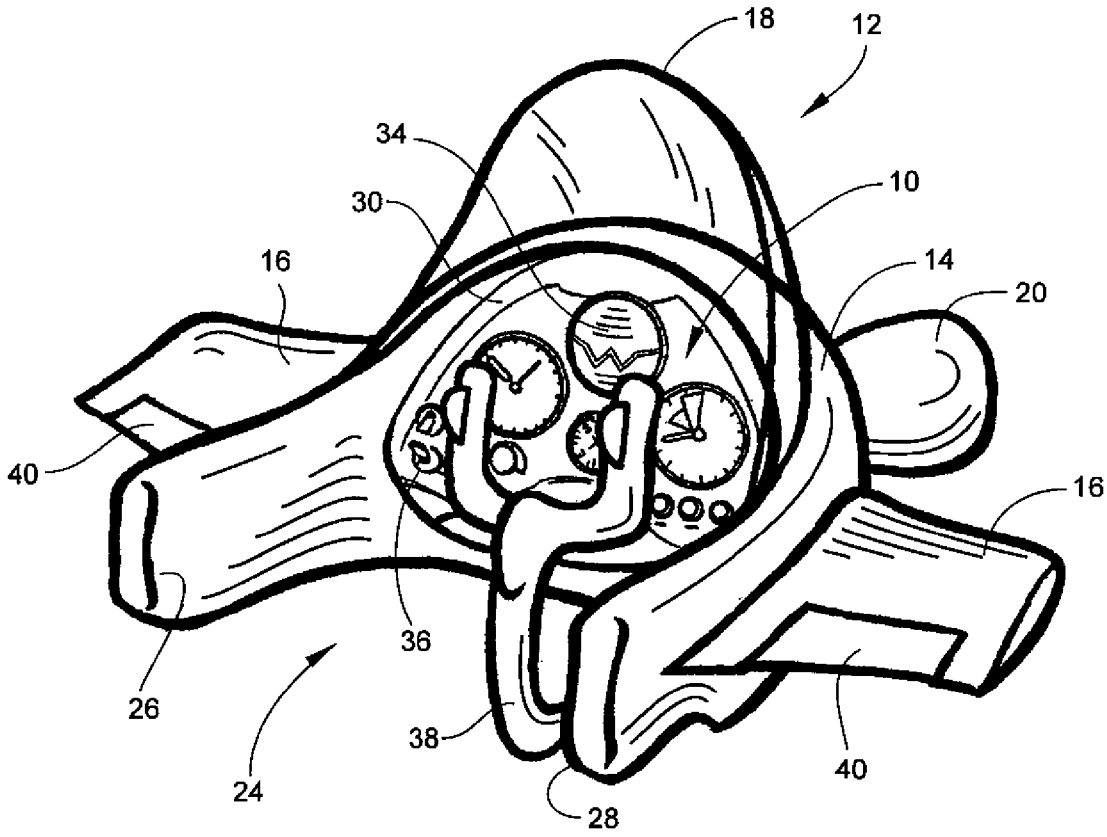
FIG. 5 is a perspective view of the interior of the body.

Referring to the drawings wherein identical reference numerals denote the same elements throughout the various views, FIGS. 1-5 illustrate an exemplary toy 10 constructed in accordance with the present invention. The toy 10 includes a body 12 which is simulative of a physical object. As used herein the term "simulative" is used in the sense that the body 12 has the form and appearance of a real object found in life, or a similar fictional object, but is merely a representation thereof. For example, the body 12 may simulate riding in a vehicle or riding on an animal, without actually being a vehicle or an animal. Various examples are described in more detail below.

In the illustrated example the body 12 is representative of and simulates a propeller-driven airplane having a fuselage 14, laterally-extending wings 16, a windscreen 18, and a propeller 20. Other non-limiting examples of possible forms include other propeller-driven aircraft, hot air balloons, and other lighter-than-air craft, jet aircraft, helicopters, rockets, spacecraft, satellites, stellar bodies (e.g. planets), sea vessels including boats and submarines, buildings, animals both real and fictional, and land vehicles including trains, trucks, and cars.

The body 12 is essentially non-structural and may be constructed of any suitable material that will represent the desired shape. One suitable material is molded plastic. One or more handles 22 adapted to be grasped by hand are mounted to the body 12 at locations on the body 22 which enable an adult user to manipulate the body 12 in use, as explained in more detail below. In the illustrated example one handle 22 is mounted under each wing 16 and extends downwardly therefrom.

The body 12 includes a recessed area 24 which is sized to receive a child in an operative relationship to the body 12. In the illustrated example the recessed area 24 is a concave-shaped simulation of a "cockpit" which is bounded by the spaced-apart, aft-extending side walls 26 and 28 of the body 12 and a front wall 30.

Figure 10:
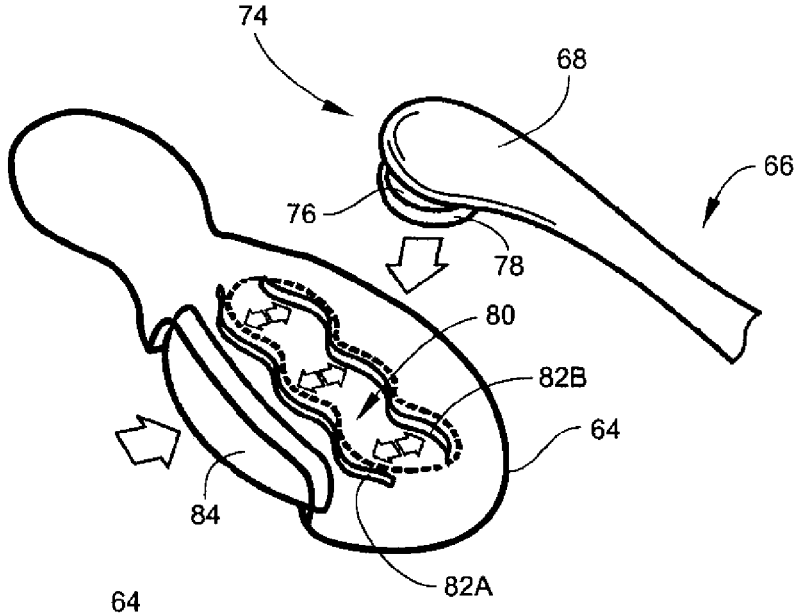
FIG. 10 is a perspective schematic view of a harness connector.

In addition to being a simulative of a "real-life" object, the body 12 may include one or more interactive features for the amusement of a child. For example, the propeller 20 may be rotatably mounted to the fuselage 14 so that it can freely spin, or it may be powered by an electric motor and batteries of a known type. The recessed area 24 may include a simulated control panel 32 as shown in FIG. 10. The control panel 32 may incorporate simulated instruments 34. These simulated instruments 34 could be simple decals, or they could include mechanical or electronic displays which mimic the behavior of real aircraft instruments. Switches 36 may be provided which are simply moveable "dummies" or which actually control functions of the toy 10 such as causing lights to illuminate, causing sounds to be produced, or causing the indications of the simulated instruments to be affected when the switches 36 are moved.

A yoke 38 or other similar primary control may be provided. This may be a simple fixed handle, or it may be used to mimic the operation of controls of a real aircraft. For example, the yoke 38 may be made relatively pivotable to the body 12 and may be mechanically connected to control surfaces such as ailerons 40 in a known fashion, such that movement of the yoke 38 causes movement of the ailerons 40. The simulated instruments 34 described above may be arranged to change their indications in response to movement of the yoke 38 or other primary control, the switches 36 or motion of the body 12 itself.

Figure 6:
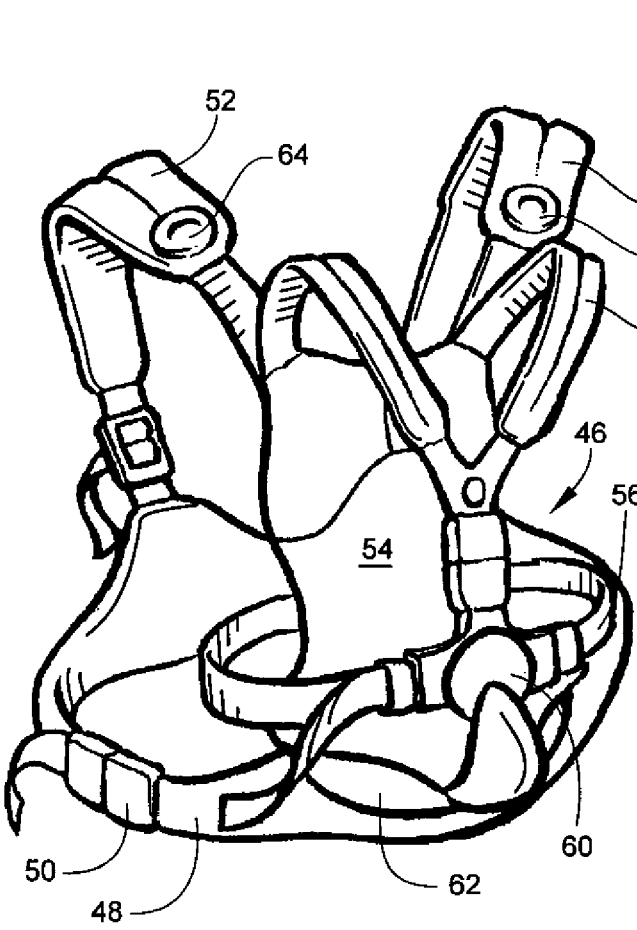
FIG. 6 is a perspective view of a harness for use with the toy.

FIG. 6 shows an exemplary harness 42 to be used with the toy 10. The harness 42 includes a carrier portion 44 and a rider portion 46. The carrier portion 46 comprises a horizontal carrier belt 48 connected by a carrier belt buckle 50 and a pair of spaced-apart vertically-oriented shoulder straps 52. It is noted that the term "buckle" is intended to encompass any structure which can be selectively fastened and released in order to secure two parts of a belt or strap together. The rider portion 46 includes a backpiece 54 to which a rider belt 56 and a Y-shaped shoulder harness 58 are attached. In the illustrated example the backpiece 54 curves downward in a "J" shape and rejoins a central buckle 60 to form a seat pan 62. The rider portion 46 is attached to the carrier portion 44 in a manner which will allow the safe bearing of the rider's weight. For example, the shoulder straps 52 may be connected to the upper end of the backpiece 54 and the carrier belt 48 may be connected to the lower end of the backpiece 54.

The harness 42 includes one or more harness mounts 64 for connecting the body 12 to the harness 42, as explained in more detail below.

Figure 7:
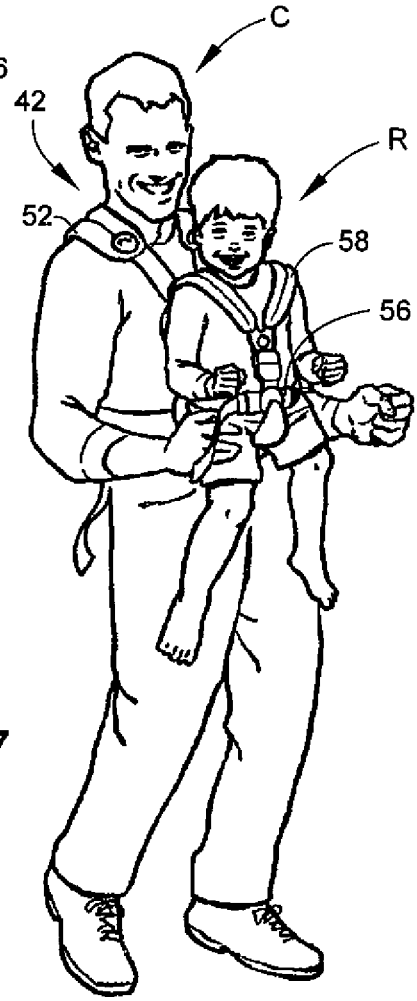
FIG. 7 is a perspective view of a child supported to an adult by the harness.

FIG. 7 shows the harness 42 in use. A carrier "C" dons the harness 42 by placing it over his shoulders with the carrier belt 48 around his waist and then connecting the carrier belt buckle 50. The carrier shoulder straps 52 and carrier belt 48 are then appropriately adjusted for a snug fit. A rider "R" is then seated in the rider portion 46 and the rider shoulder harness 58 and rider belt 56 are fastened around the rider R and tightened as needed. In this arrangement, the rider R is connected to and supported by the carrier C, and any motion of the carrier's body (e.g. walking, running, pitching, rolling, etc.) is transferred to the rider's body. It should be noted that the toy is envisioned to be used most frequently by a physically mature adult carrier C to carry a relatively small child rider R. However, the toy 10 and harness 42 could obviously be used by other persons, such as a larger child and a smaller child.

Figure 8:
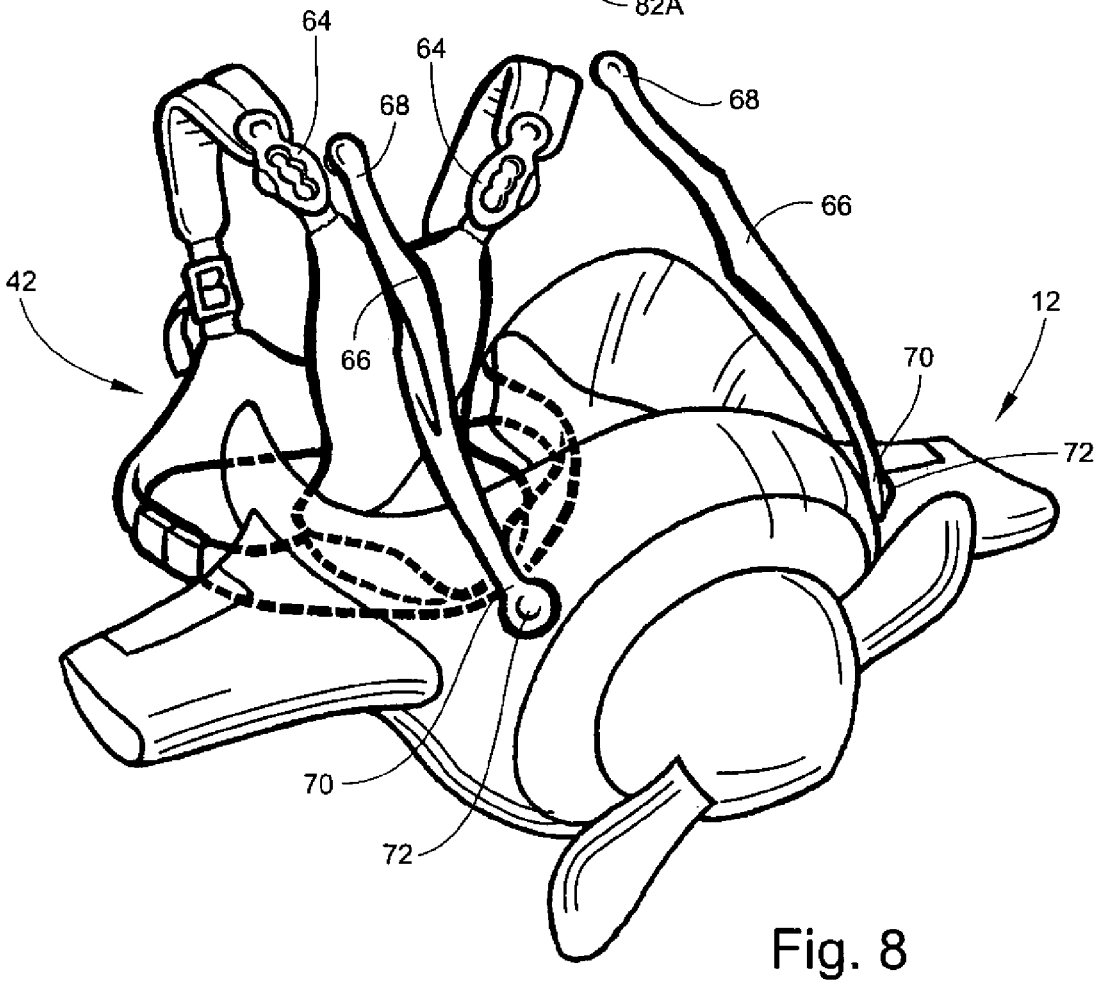
FIG. 8 is an exploded front perspective view of the body with the harness in position to be attached thereto.
Figure 9:
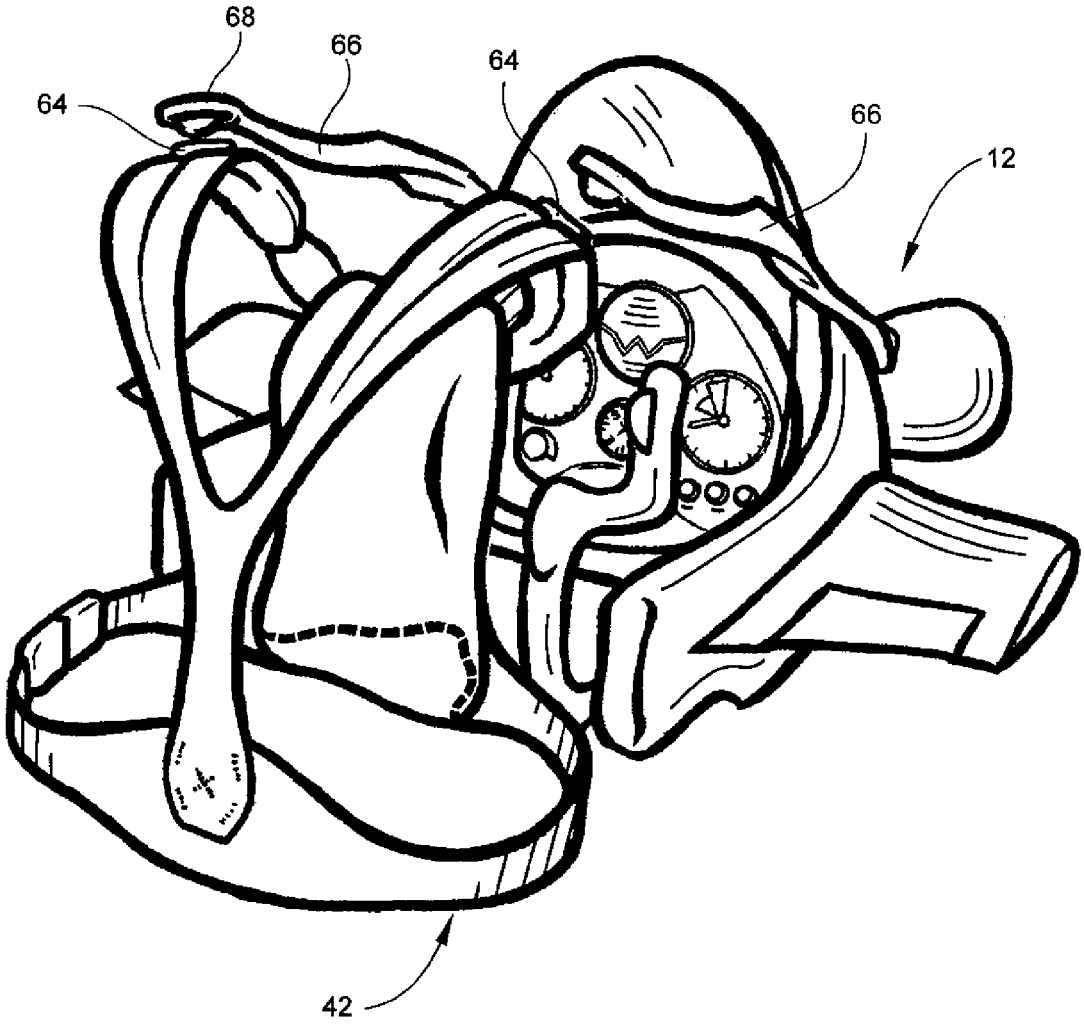
FIG. 9 is an exploded rear perspective view of the body with the harness in position to be attached thereto.

FIGS. 8-10 show the mounting arrangement of the body 12 in more detail. The toy 10 includes at least one support strap 66 having upper and lower ends 68 and 70. The support strap 66 may be flexible or it may be relatively rigid, so long as it will support a tensile load. The lower end 70 of each support strap 68 is connected to a body mount 72 disposed on the body 12, and the upper end 68 of each support strap 66 is connected to one of the harness mounts 64. The weight of the body 12 is mostly supported by the harness 42, and the aft end of the body 12 rests against the carrier's torso or hips. FIG. 1 illustrates the body 12 in position mounted to the harness 42 and resting against a carrier's body.

It is envisioned that the toy 10 may include a "quick-release" type of attachment for the support straps 66. In the example shown in FIGS. 8 and 9, the upper end 68 of each support strap 66 includes a protruding stud 74 having a shank 76 and an enlarged head 78. The cooperating harness mount 64 includes a central opening 80 containing a pair of jaws 82A and 82B, at least one of which is moveable so the jaws 82A, 82B can be selectively varied between a "closed" position in which the width therebetween is larger than the shank 76 and smaller than the head 78, and an "open" position in which the width between the jaws 82A, 82B is larger than the diameter of the head 78. The jaws 82A, 82B may be spring-biased to the closed position and may be releasable to the open position by use of a release button 84. Thus, when the stud 74 is placed between the jaws 82A, 82B, it is held in place but is free to pivot. When it is desired to detach the support straps 66 the jaws 82A, 82B are opened so that the stud 74 can be removed. This system of attachment makes it particularly easy for a carrier C to use only one hand to pick up the body 12 by a support strap 66 and attach the support straps 66 to the harness mounts 64 one at a time, while the other hand remains free to attend to the rider R.

Figure 11:
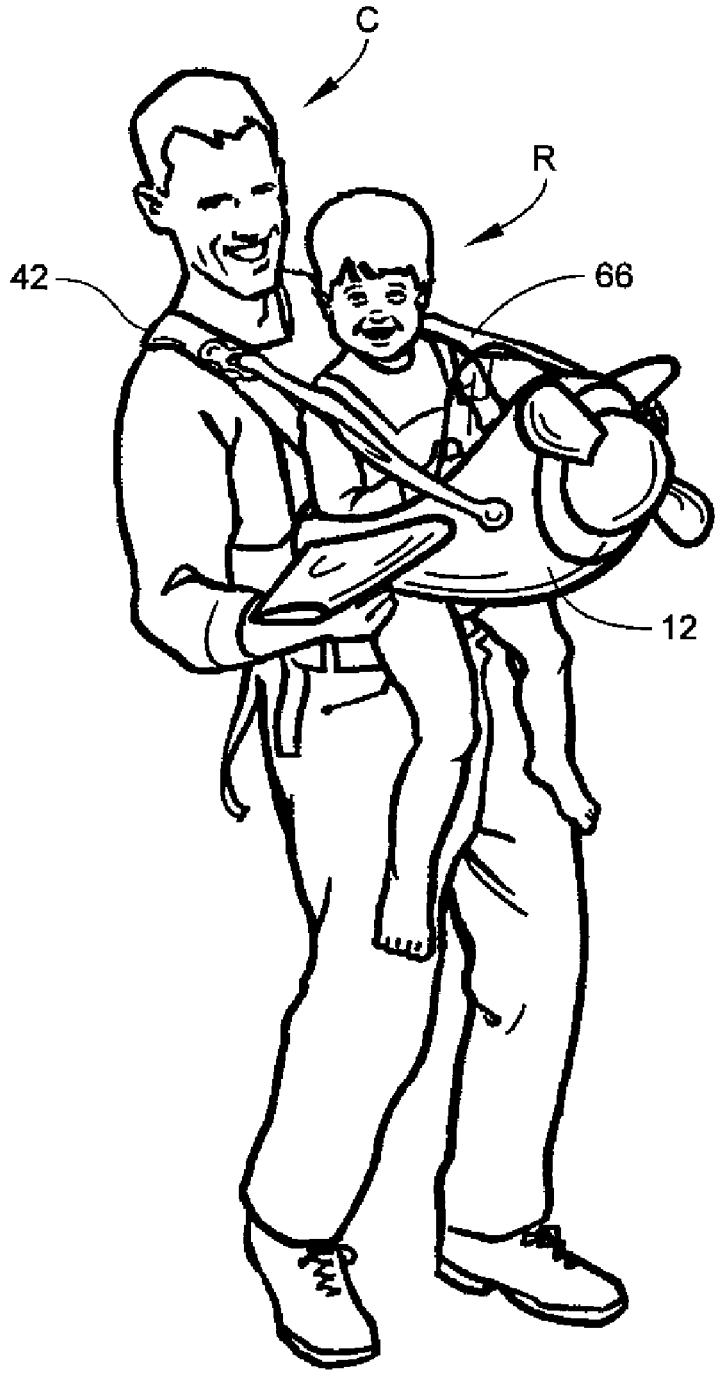
FIG. 11 is a perspective view of a parent holding the toy and a child.

FIG. 11 illustrates the toy 10 in use. The rider R is supported in the harness 42 as described above, and the body 12 is mounted in front of the rider R. Thus arranged, the carrier C may freely walk, run, sit, stand, bend down, stretch upwards, and so forth. Furthermore, the carrier C may use his or her hands to manipulate the body using the handles 22. It is envisioned that the carrier C may imitate the motion of the object which is simulated by the body 12. For example, the carrier C may cause the body 12 to move forward as well as "rolling", "banking", "climbing", "diving", and other maneuvers that a real aircraft would undergo. During the process the rider R is free to manipulate the controls, play with the switches 36, make, noises simulating the plane in flight, and so forth. This activity is relatively easy for the carrier C because the main weight of the rider R and the body 12 are supported by the carrier's shoulder and body, rather than his or her arms.

Figure 13:
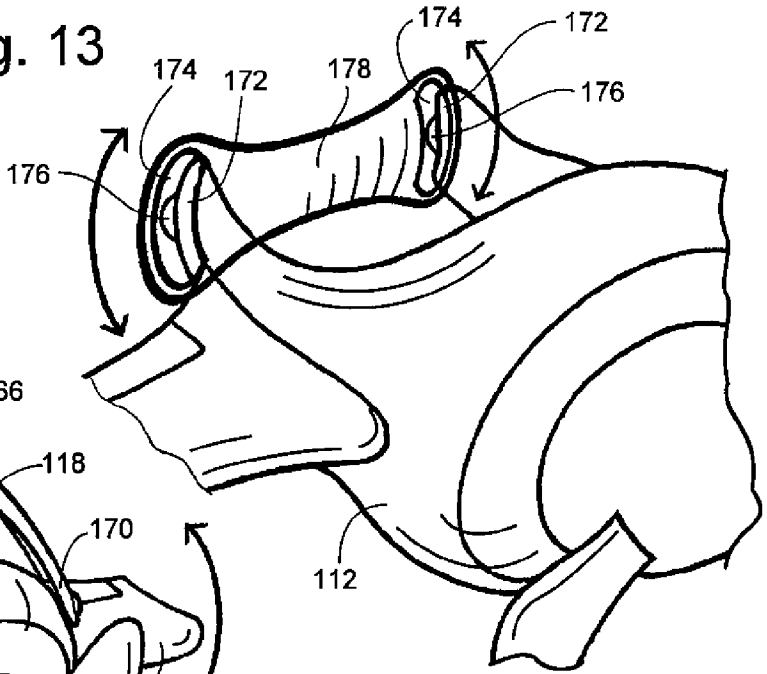
FIG. 13 is an enlarged perspective view of the rear of the toy of FIG. 12.
Figure 14:
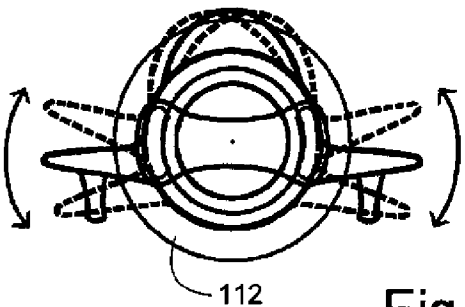
FIG. 14 is a front view of the toy of FIG. 12 showing a rolling motion thereof.
Figure 12:
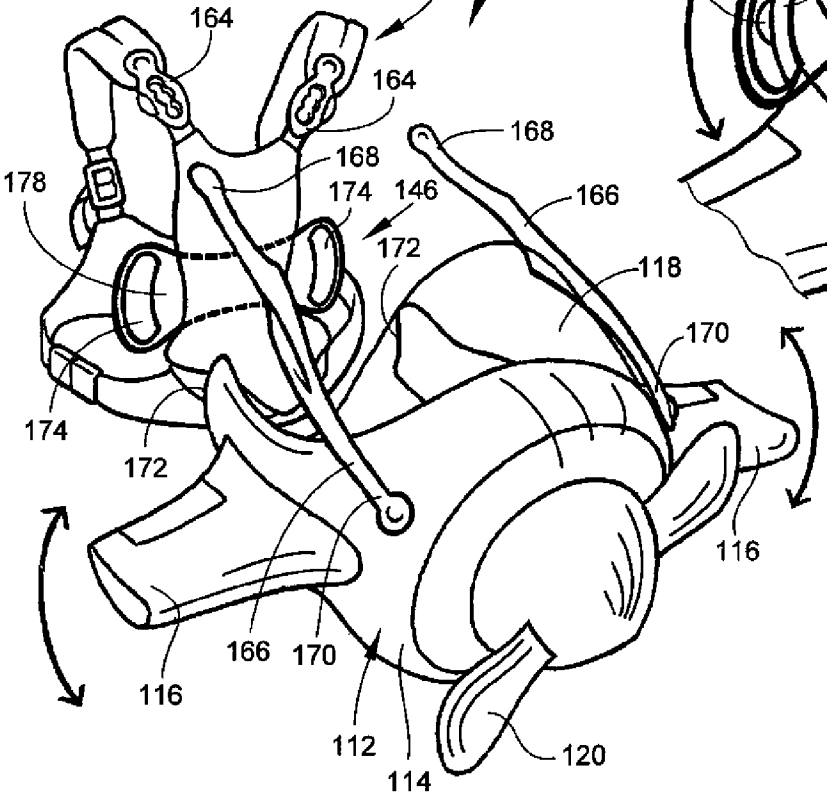
FIG. 12 is a perspective view of a toy which incorporates an alternative harness mounting arrangement.

FIGS. 12, 13, and 14 illustrate an alternative toy 110. The body 112 is substantially similar in construction to the toy 10 described above and includes a fuselage 114, laterally-extending wings 116, a windscreen 118, and a propeller 120. The body 112 includes at least one support strap 166 having upper and lower ends 168 and 170. The body 112 includes a pair of spaced-apart bearing surfaces 172 at the aft end thereof. The purpose of the bearing surfaces 172 is to prevent the aft end of the body 112 from uncomfortably pressing against the body of a carrier C. They also allow low-friction contact between the bearing surfaces 172 and corresponding bearing pads 174 attached to a harness (described below). The bearing surfaces 172 may simply be a pair of smooth plastic faces. Alternatively, they could be coated with a low-friction compound such as polytetrafluoroethylene (PTFE), or they could incorporate spherical rollers 176 therein (see FIG. 13).

The body 112 cooperates with a harness 142. The harness 142 is substantially similar to the harness 142 described above and includes a carrier portion 144, a rider portion 146, and a pair of spaced-apart harness mounts 164. The harness 142 also includes a transverse bearing plate 178 which carries the bearing pads 174. The purpose of the bearing pads 174 is to allow low-friction contact between the bearing pads 174 and the corresponding bearing surfaces 172 (described above). The bearing pads 174 may simply be a pair of smooth plastic faces. Alternatively, they could be coated with a low-friction compound such as polytetrafluoroethylene (PTFE), or they could incorporate spherical rollers therein (not shown).

When the body 112 is attached to the harness 142, the lower end 170 of each support strap 166 is connected to the body 112 and the upper end 168 of each support strap 166 is connected to one of the harness mounts 164. The weight of the body 112 is mostly supported by the harness 142. The bearing surfaces 172 press against the bearing pads 174. This arrangement allows the body 112 to undergo "rolling" motions relative to the harness 142 more easily than the embodiment described above, as illustrated in FIG. 14.

Figures 15, 16, 17:
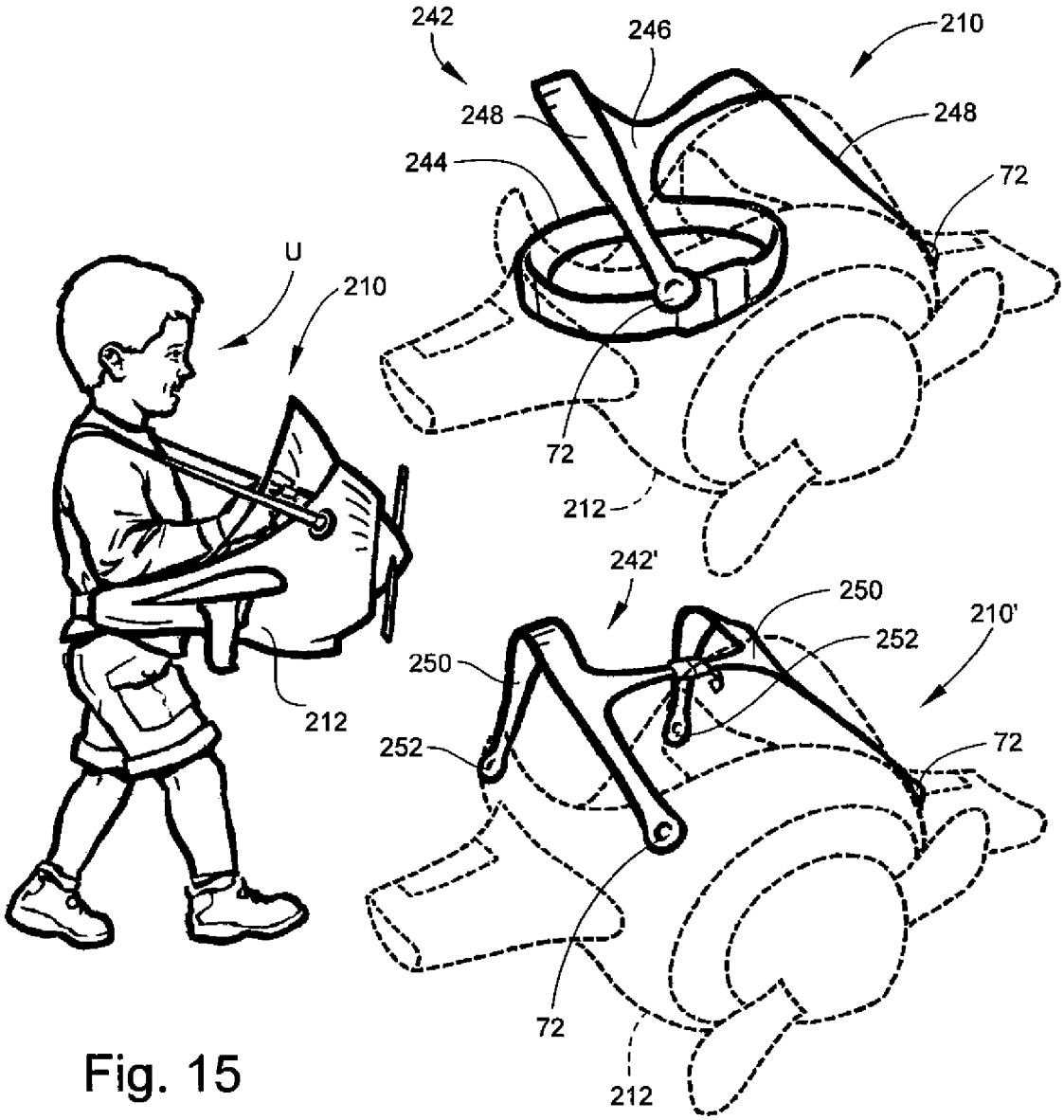
FIG. 15 is a side view of an alterative toy which may be directly worn by a child.
FIG. 16 is a perspective view of one method of attaching the toy of FIG. 15 to a child.
FIG. 17 is a perspective view of another method of attaching the toy of FIG. 15 to a child.
Figure 18:
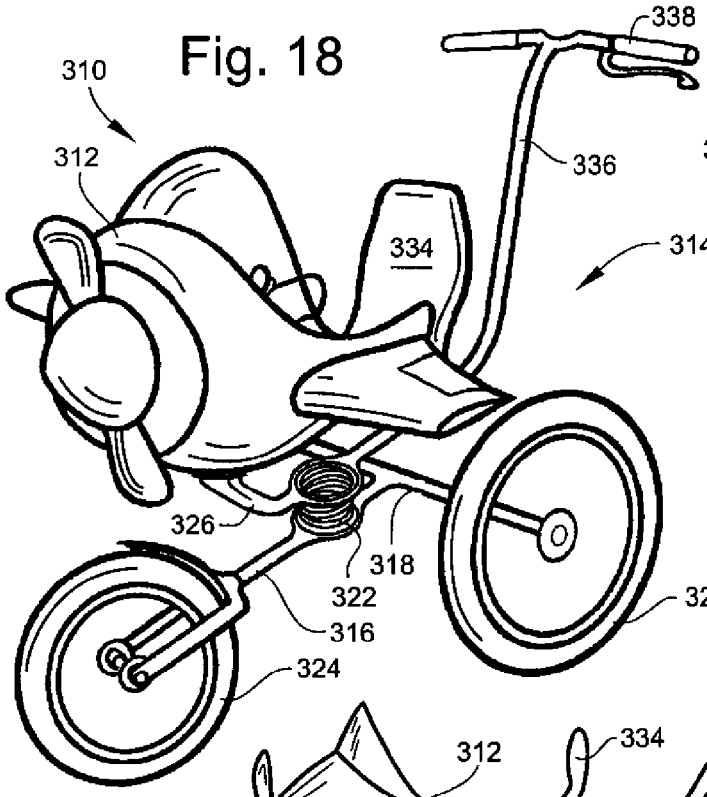
FIG. 18 is a perspective view of an alternative toy mounted on a rolling chassis.
Figure 20:
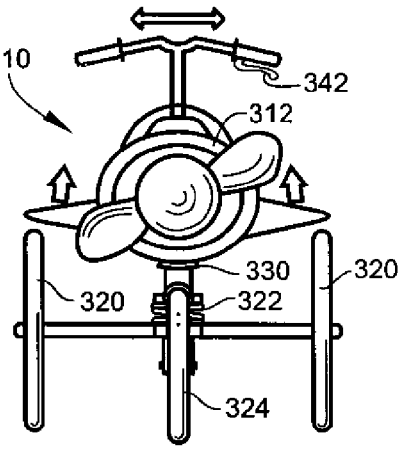
FIG. 20 is a front view of the toy of FIG. 18.
Figure 19:
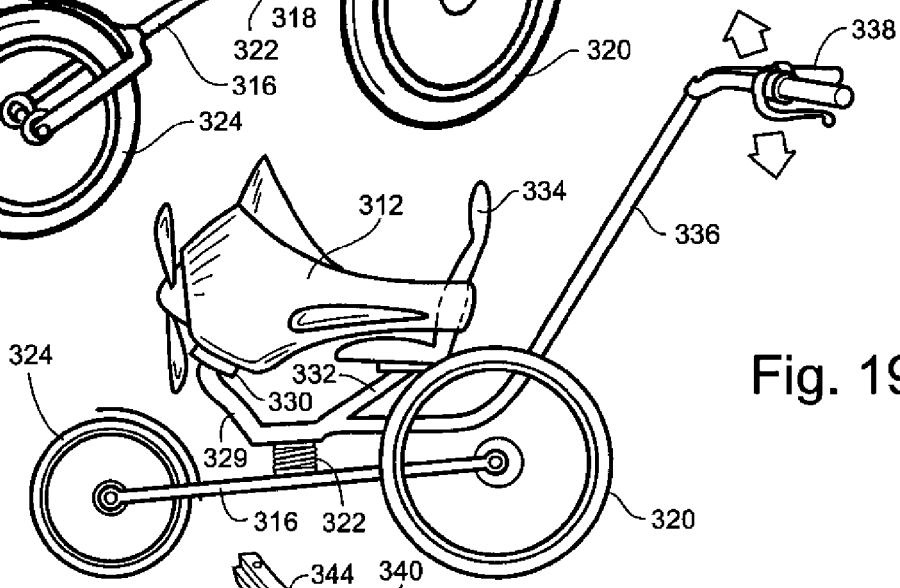
FIG. 19 is a side view of the toy of FIG. 18.

FIGS. 15-17 illustrate another embodiment of the toy 210. In this variation, the toy 210 may be worn by a child user "U" directly without the assistance of a carrier, as shown in FIG. 15. This extends the useful life of the toy 210, as it may be enjoyed by a child even after he or she has grown too large to be comfortably carried by an adult. The toy 210 includes a body 212 identical in construction to the body 12 described above. A harness 242 is provided which allows the body 212 to hang directly from the user U. The harness 242 make take various forms. In the variation shown in FIG. 16, the harness 242 includes a belt strap 244 connected to a "Y"-shaped shoulder harness 246 having two forward straps 248. These forward straps 248 connect directly to the same body mounts 72 which are used to connect the support straps 66 described above. FIG. 17 illustrates a slightly simpler, "H"-shaped shoulder harness 242' having a pair of spaced-apart longitudinal straps 250 which connect at their forward ends to the body mounts 72, and at their aft ends to the aft end of the body 212, for example to an additional pair of spaced-apart rear body mounts 252.

FIGS. 18-22 illustrate yet another embodiment of the toy 310 which may extend the useful life of the toy 310, after a child has grown too large to be comfortably carried by an adult. The toy 310 includes a body 312 identical in construction to the body 312 described above. A wheeled chassis 314 is provided which supports the body 312. The chassis 314 includes a lower frame 316 having a rear axle 318 carrying a pair of spaced-apart rear wheels 320, a pivotable mount 322, and a front wheel 324. An upper frame 326 is attached to the pivotable mount 322 and includes a forward upright 328 carrying a frame bracket 330, a rear upright 332 carrying a seat 334, and an upwardly-extending handle 336 having a pair of handlebars 338 at its upper end. The chassis 314 make take various forms depending upon the particular application. The body 312 has a body bracket 340 attached to a lower surface thereof which engages the frame bracket 330 and locks the body securely to the upper frame 326. Thus assembled, the toy 310 may be rolled along by an adult while a child rides in the seat 334. The pivotal mount 322 allows the adult to manipulate the upper frame 326 to simulate "pitching" and "rolling" motions of the body 312. A brake (not shown) of a known type may be provided, controlled by a brake lever 342, to provide stopping ability for the chassis 314.

Figure 21:
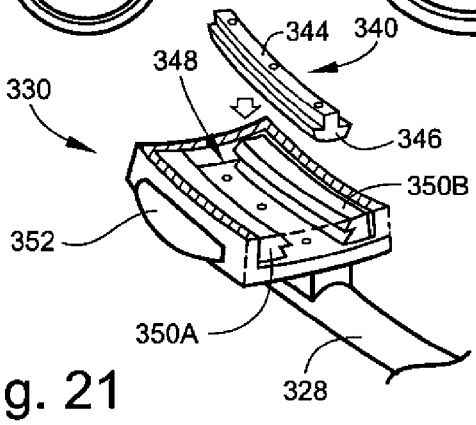
FIG. 21 is a perspective view of a portion of the rolling chassis showing an attachment means.
Figure 22:
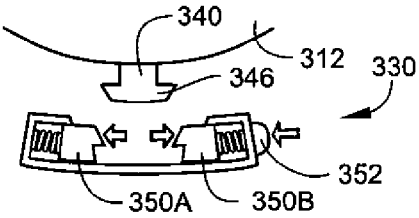
FIG. 22 is a partial front view of the rolling chassis showing a latch.

FIGS. 21 and 22 illustrate the construction of the frame and body brackets 330 and 340. FIG. 21 shows the body bracket 340 with the body 312 removed for clarity of illustration. The body bracket 340 is generally "T" shaped in cross-section and has a central portion 344 and an enlarged crossbar 346. The frame bracket 330 includes an elongated central opening 348 containing a pair of flanged rails 350A and 350B, at least one of which is moveable so the rails 350A, 350B can be selectively varied between a "closed" position in which the width therebetween is larger than the central portion 344 of the body bracket 340 and smaller than the crossbar 346, and an "open" position in which the width between the rails 350A, 350B is larger than the diameter of the crossbar 346. The rails 350A, 350B may be spring-biased to the closed position and may be releasable to the open position by use of a release button 352. Thus, when the body bracket 340 is placed between the rails 350A, 350B it is rigidly held in place.

Figure 23:
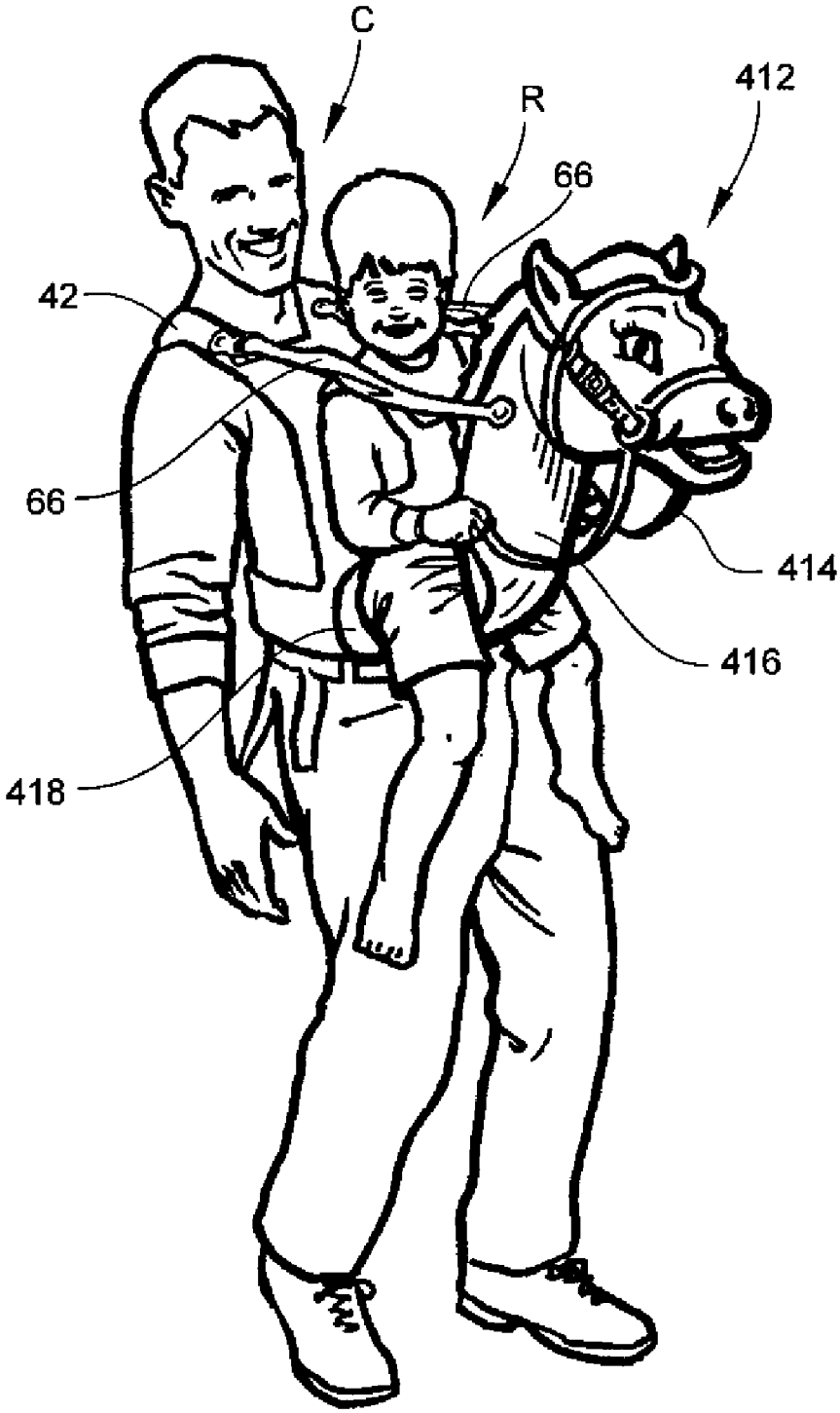
FIG. 23 is a perspective view of a toy including an alternative body.
Figure 24:
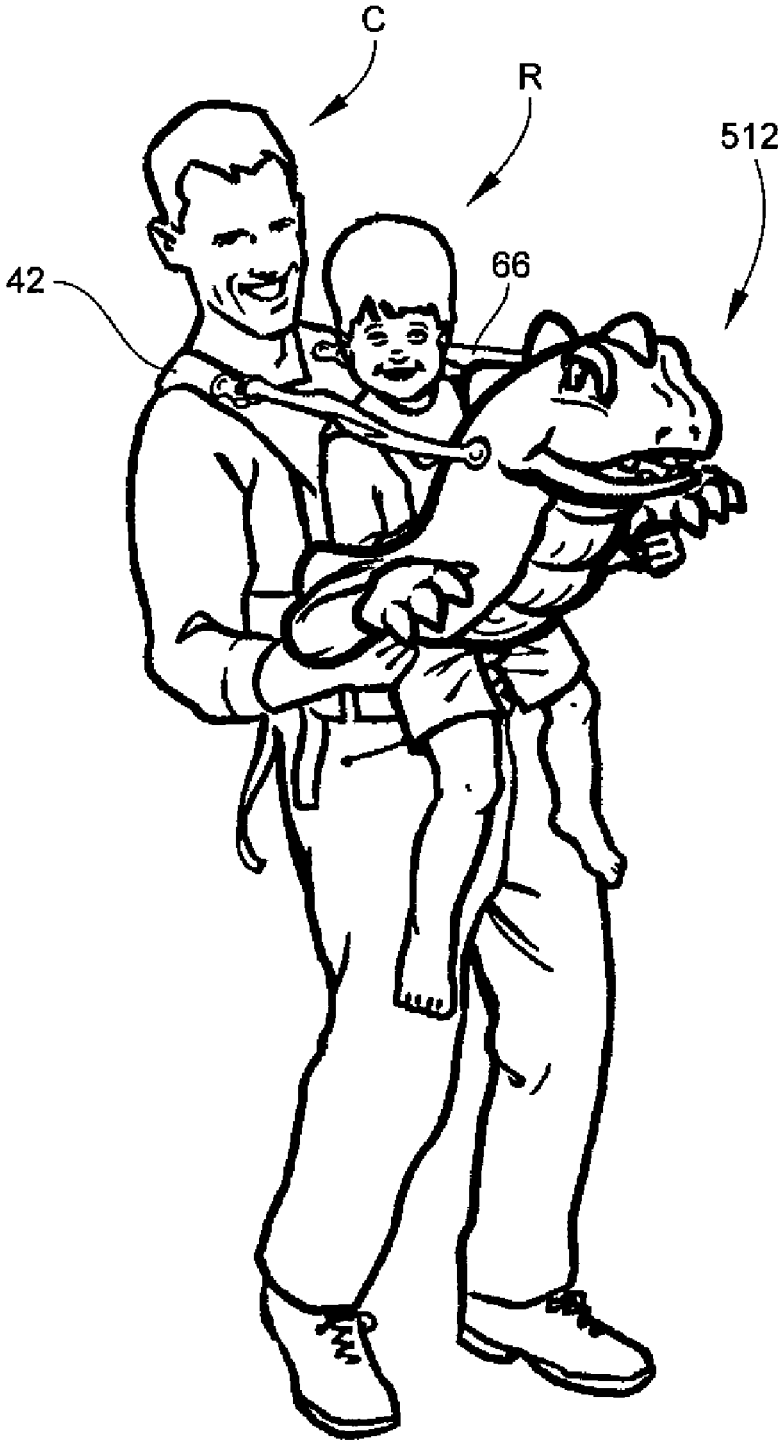
FIG. 24 is a perspective view of a toy including another alternative body.

FIGS. 23 and 24 illustrate other variations of the toy 10. In the variation shown in FIG. 23, a body 412 is simulative of a horse, and includes reins 414 as an interactive feature for the rider R to play with. The body 412 differs somewhat from the airplane-shaped body 12 described above in that the neck portion 416 does not surround the rider R, but rather extends between the rider's legs, and defines a recessed area 418 having a "saddle" shape, in order to receive the rider R in a way which more closely simulates the act of riding a horse. The harness 42 and support straps 66 used to attach the body 412 thereto may be exactly as those described above, and in fact the body 412 may be interchangeable with the body 12.

FIG. 24 illustrates yet another variation in which the body 512 is simulative of a lizard, dinosaur, or an imaginary character such as a "dragon". The structural aspects of the body 512 are substantially similar to those of the airplane-shaped body 12 described above, and the body 512 may be interchangeable therewith.

The foregoing has described a riding toy. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation, the invention being defined by the claims.

What is claimed is:

1. A riding toy, comprising:

a body simulating a physical object and having an open-ended recessed area adapted to receive a human user's torso, the recessed area being bounded by laterally spaced-apart, aft-extending sidewalls of the body; and a harness attached to said body and adapted to be worn by a user so as to support said body in the front of the user;

wherein the harness is further adapted to be worn by a human carrier and includes means for supporting said rider and said body in front of said human carrier.

2. The riding toy of claim 1, wherein said body includes a simulated control panel.

3. The riding toy of claim 2, wherein said control panel includes at least one simulated instrument.

4. The riding toy of claim 2, wherein said control panel includes at least one switch.

5. The riding toy of claim 4, wherein said switch is operatively connected to said simulated instrument so as to cause a change in the indication of said simulated instrument in response to movement of said switch.

6. The riding toy of claim 1, wherein said body is representative of an aircraft having a fuselage and a pair of laterally-extending wings.

7. The riding toy of claim 1 wherein said body includes at least one simulated instrument, wherein said instrument is operable to change an indication thereof in response to the movement of at least one of:

a primary control carried by said body, or motion of said body.

8. A riding toy, comprising:

a body simulating a physical object and having an open-ended recessed area adapted to receive a human user's torso, the recessed area being bounded by laterally spaced-apart, aft-extending sidewalls of the body; and a harness attached to said body and adapted to be worn by a user so as to support said body in the front of the user;

a wheeled chassis including a seat for said rider, said chassis adapted to support said body in operative relationship to said rider in said seat; and means for selectively attaching said body to said support chassis.

9. The riding toy of claim 8, wherein said body includes a simulated control panel.

10. The riding toy of claim 9, wherein said control panel includes at least one simulated instrument.

11. The riding toy of claim 9, wherein said control panel includes at least one switch.

12. The riding toy of claim 11, wherein said switch is operatively connected to said simulated instrument so as to cause a change in the indication of said simulated instrument in response to movement of said switch.

13. The riding toy of claim 8, wherein said body is representative of an aircraft having a fuselage and a pair of laterally-extending wings.

14. The riding toy of claim 8, wherein said body includes at least one simulated instrument, wherein said instrument is operable to change an indication thereof in response to the movement of at least one of:

a primary control carried by said body, or motion of said body.

* * * * *